US010215365B2

(12) United States Patent
Yu et al.

(10) Patent No.: US 10,215,365 B2
(45) Date of Patent: Feb. 26, 2019

(54) LIGHTING DEVICE AND METHOD FOR MANUFACTURING THE SAME

(71) Applicant: SAMSUNG ELECTRONICS CO., LTD., Suwon-si, Gyeonggi-do (KR)

(72) Inventors: Byeong Hyeon Yu, Seoul (KR); Wook Pyo Lee, Cheonan-si (KR); Ariyoshi Tetsuo, Suwon-si (KR); Ji Hoon Yun, Seoul (KR); Cheon Ho Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 617 days.

(21) Appl. No.: 14/388,996

(22) PCT Filed: Mar. 27, 2013

(86) PCT No.: PCT/KR2013/002523

§ 371 (c)(1),
(2) Date: Sep. 29, 2014

(87) PCT Pub. No.: WO2013/147504

PCT Pub. Date: Oct. 3, 2013

(65) Prior Publication Data

US 2015/0022999 A1 Jan. 22, 2015

(30) Foreign Application Priority Data

Mar. 30, 2012 (KR) ..... 10-2012-0033624
Mar. 30, 2012 (KR) ..... 10-2012-0033625

(51) Int. Cl.
*F21K 9/64* (2016.01)
*F21K 9/69* (2016.01)
(Continued)

(52) U.S. Cl.
CPC ..... *F21V 9/00* (2013.01); *F21K 9/275* (2016.08); *F21K 9/64* (2016.08); *F21K 9/69* (2016.08);
(Continued)

(58) Field of Classification Search
CPC ..... F21K 9/27; F21K 9/64; F21K 9/90; F21V 29/2206; F21V 29/74; F21V 29/763;
(Continued)

(56) References Cited

U.S. PATENT DOCUMENTS 3,525,544 A * 8/1970 Jacobs ..... E05D 15/507 16/232
5,607,227 A * 3/1997 Yasumoto ..... H04N 1/00909 257/100
(Continued)

FOREIGN PATENT DOCUMENTS

CN 102338307 A 2/2012
TW 201030277 A1 8/2010
(Continued)

OTHER PUBLICATIONS

International Search Report dated Jul. 25, 2013, in corresponding International Patent Application No. PCT/KR2013/002523.
(Continued)

*Primary Examiner* — Tsion Tumebo
(74) *Attorney, Agent, or Firm* — Staas & Halsey LLP

(57) ABSTRACT

A lighting device in which a heat sink and a cover are formed by co-extrusion and a manufacturing method for the same are provided. The heat sink and the cover may be co-extruded. A shape control portion may be formed at the heat sink to control a shape of a seating portion to seat a circuit substrate during extrusion of the heat sink. In addition, a light characteristic control portion may be provided between
(Continued)

a light emitting diode (LED) and the cover to control characteristic of light generated from the LED.

27 Claims, 14 Drawing Sheets

(51) Int. Cl.

| | |
|---|---|
| ***F21K 9/90*** | (2016.01) |
| ***F21V 9/00*** | (2018.01) |
| ***F21K 9/275*** | (2016.01) |
| ***F21V 29/74*** | (2015.01) |
| ***F21V 29/76*** | (2015.01) |
| ***F21Y 103/10*** | (2016.01) |
| ***F21Y 115/10*** | (2016.01) |

(52) U.S. Cl.
CPC ..... *F21K 9/90* (2013.01); *F21V 29/74* (2015.01); *F21V 29/763* (2015.01); *F21Y 2103/10* (2016.08); *F21Y 2115/10* (2016.08); *Y10T 29/4913* (2015.01)

(58) Field of Classification Search
CPC .... F21V 9/00; F21Y 2103/10; F21Y 2115/10; Y10T 29/4913
USPC ..... 362/293, 294, 373, 84; 29/832
See application file for complete search history.

(56) References Cited

U.S. PATENT DOCUMENTS 7,192,161 B1 * 3/2007 Cleaver ..... F21V 9/30 362/260
7,307,391 B2 * 12/2007 Shan ..... B60Q 1/2611 315/291
8,201,977 B2 * 6/2012 Thomas ..... A47F 3/001 362/125
8,319,407 B2 * 11/2012 Ke ..... F21K 9/275 257/269
8,376,579 B2 * 2/2013 Chang ..... F21V 5/02 362/218
8,471,494 B2 * 6/2013 Broitzman ..... H05B 33/0803 315/291
8,764,220 B2 * 7/2014 Chan ..... F21V 15/013 362/217.02
8,956,005 B2 * 2/2015 Thomas ..... F21S 4/008 362/217.1
2005/0281024 A1 * 12/2005 Mayfield, III ..... F21S 8/04 362/221
2007/0047229 A1 * 3/2007 Lee ..... F21V 5/04 362/237
2008/0007945 A1 * 1/2008 Kelly ..... A47F 3/001 362/218
2009/0219713 A1 * 9/2009 Siemiet ..... F21V 3/02 362/218
2010/0110685 A1 5/2010 Pei et al.
2010/0201269 A1 * 8/2010 Tzou ..... F21V 23/006 315/51
2010/0265693 A1 * 10/2010 Ryu ..... F21V 5/04 362/84
2010/0321921 A1 * 12/2010 Ivey ..... F21K 9/64 362/84
2011/0149548 A1 * 6/2011 Yang ..... F21V 5/04 362/84
2011/0280010 A1 * 11/2011 Ou ..... F21V 5/043 362/217.02
2011/0286207 A1 * 11/2011 Chan ..... F21V 15/013 362/217.1
2011/0310604 A1 * 12/2011 Shimizu ..... F21V 15/015 362/235
2012/0051040 A1 3/2012 Hsia et al.
2012/0106144 A1 * 5/2012 Chang ..... F21K 9/17 362/218
2012/0236562 A1 9/2012 Tran
2013/0039051 A1 * 2/2013 Wu ..... F21V 31/00 362/218
2013/0077297 A1 * 3/2013 Wu ..... F21V 17/12 362/218
2014/0160742 A1 * 6/2014 Rodgers ..... F21V 23/02 362/222

FOREIGN PATENT DOCUMENTS

WO WO 2009/154321 A1 12/2009
WO WO 2012/009921 A1 1/2012

OTHER PUBLICATIONS

Chinese Office Action dated Apr. 26, 2017 in corresponding Chinese Patent Application No. 201380018647.0.
Chinese Office Action dated Jul. 27, 2018 in Chinese Patent Application No. 201380018647.0.

* cited by examiner

[Fig. 1]
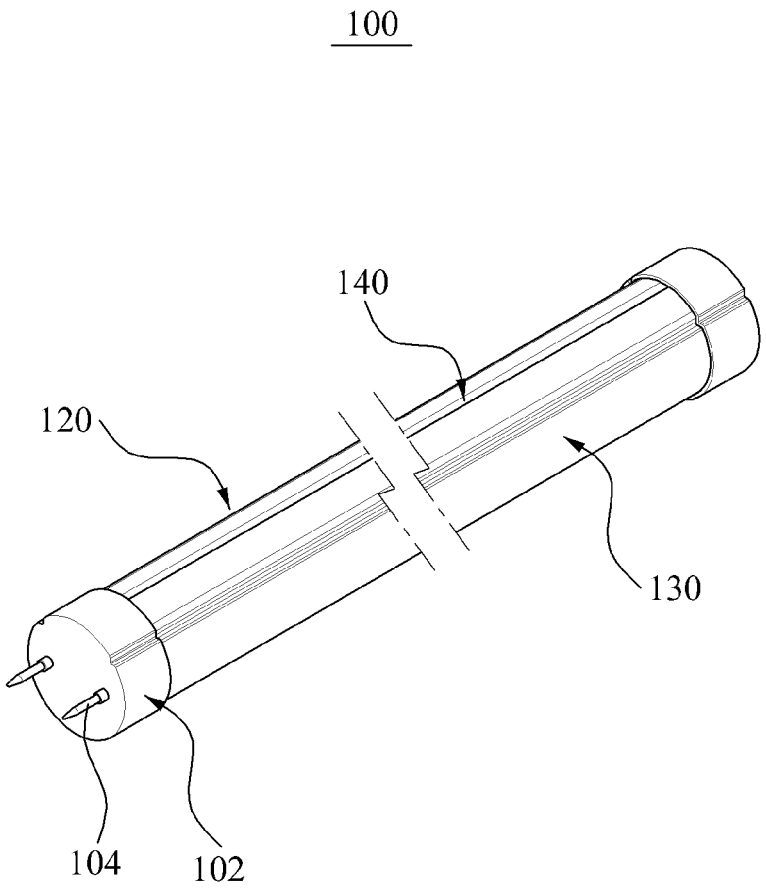

[Fig. 2]
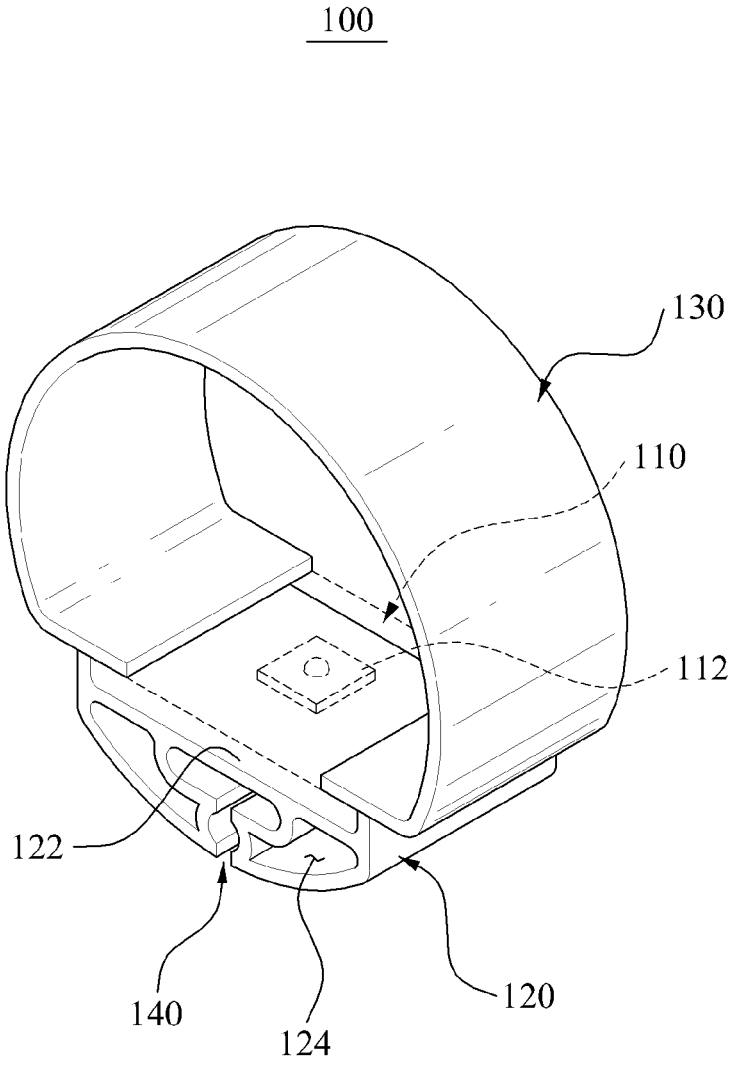

[Fig. 3]
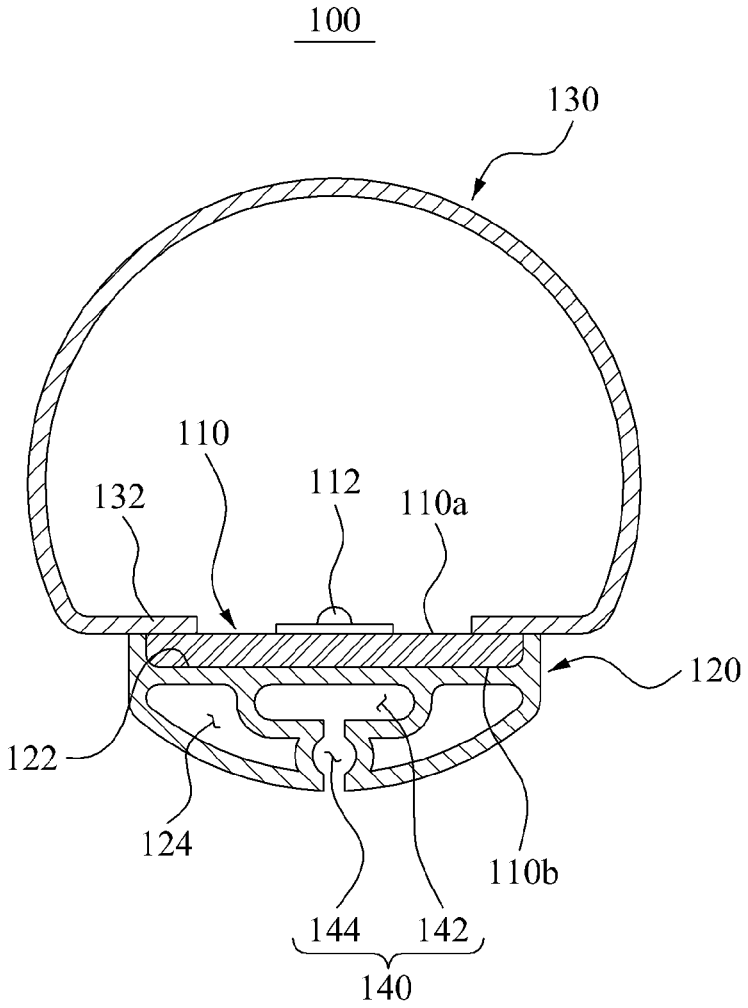

[Fig. 4]
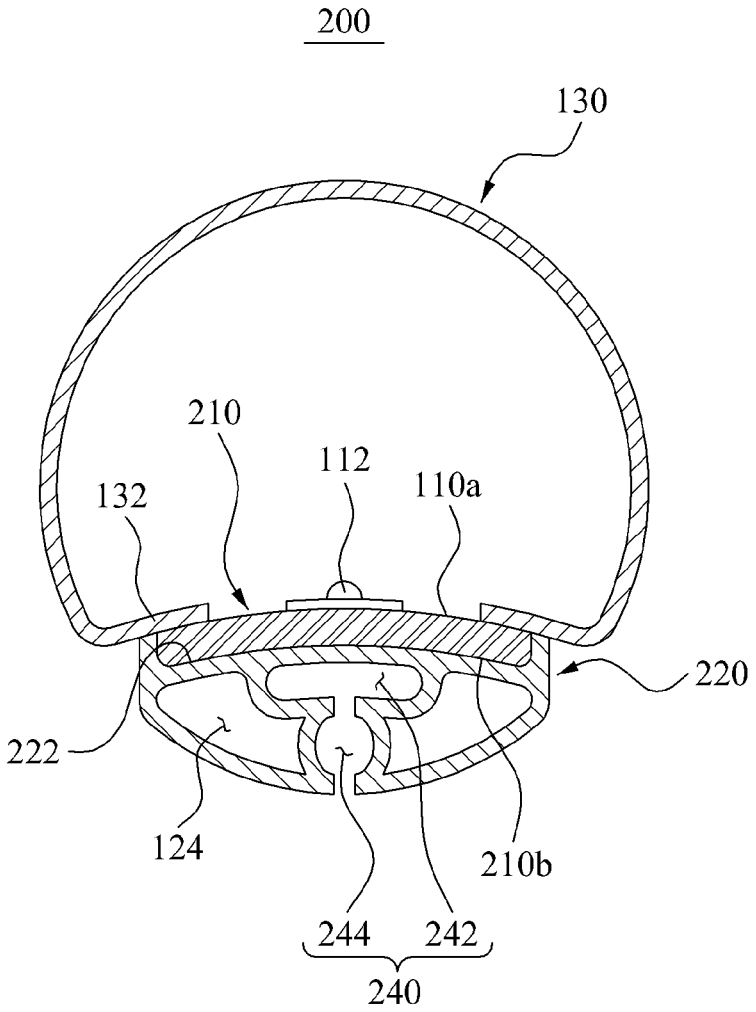

[Fig. 5]
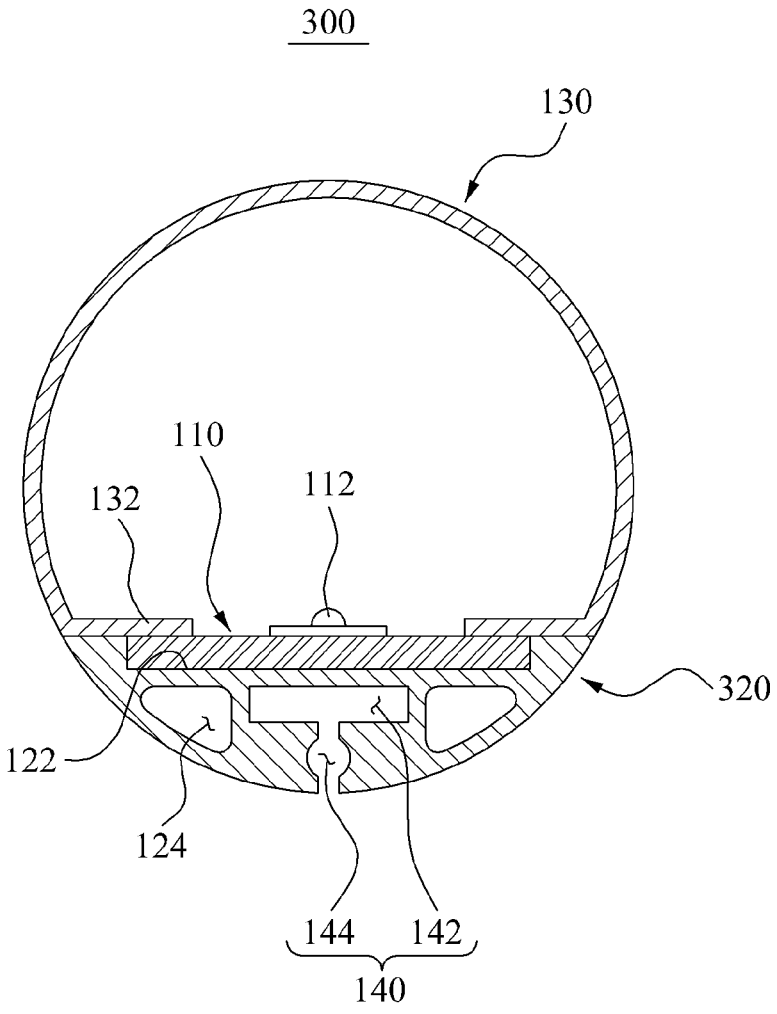

[Fig. 6]
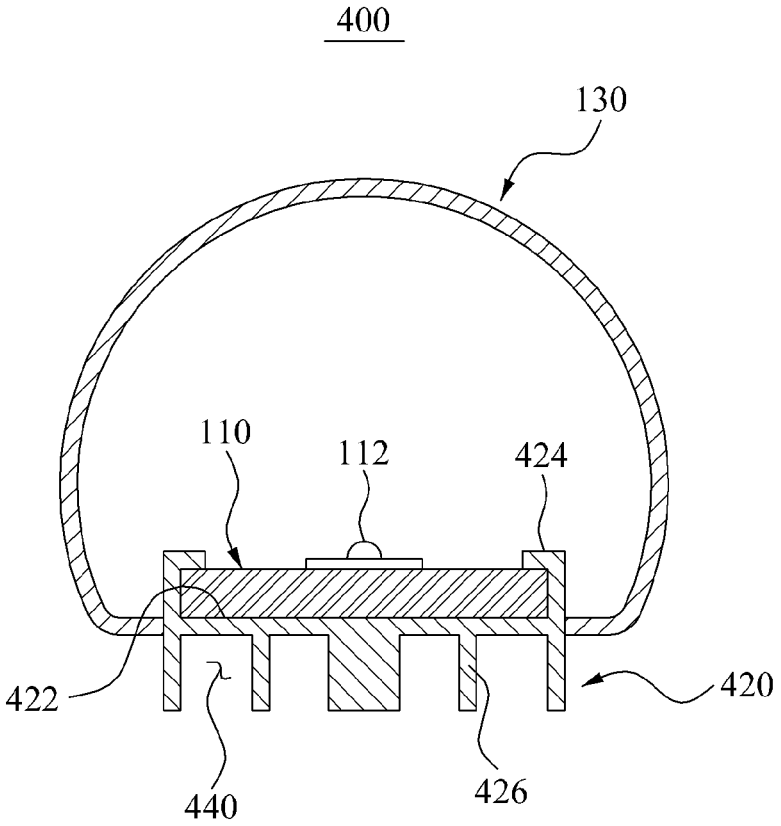

[Fig. 7]
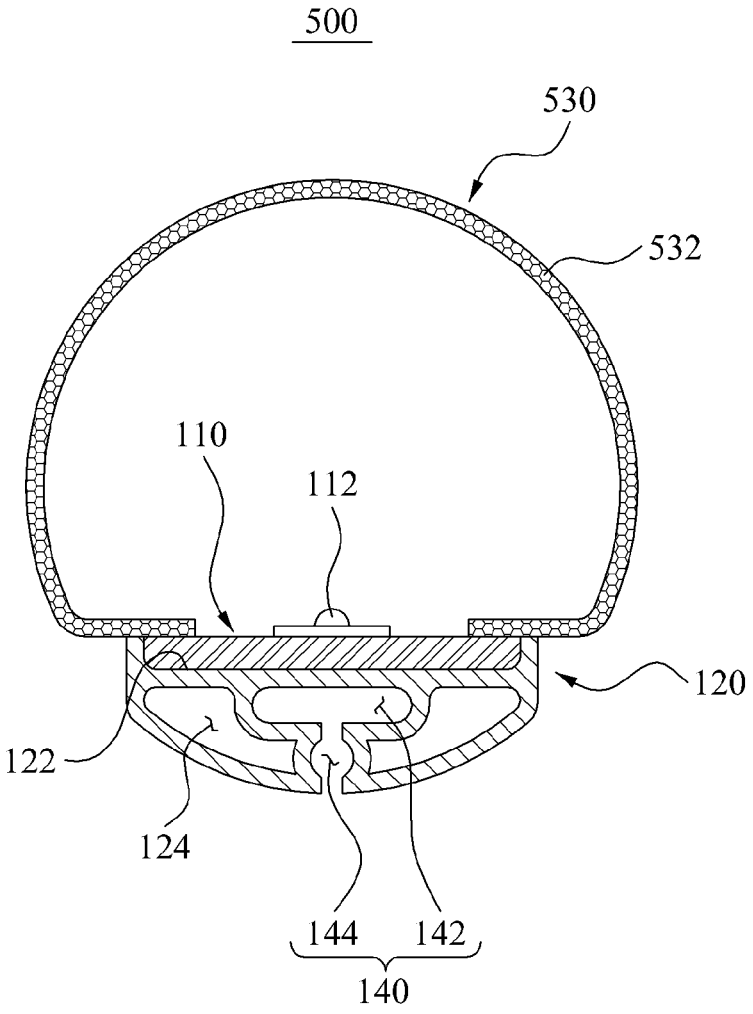

[Fig. 8]
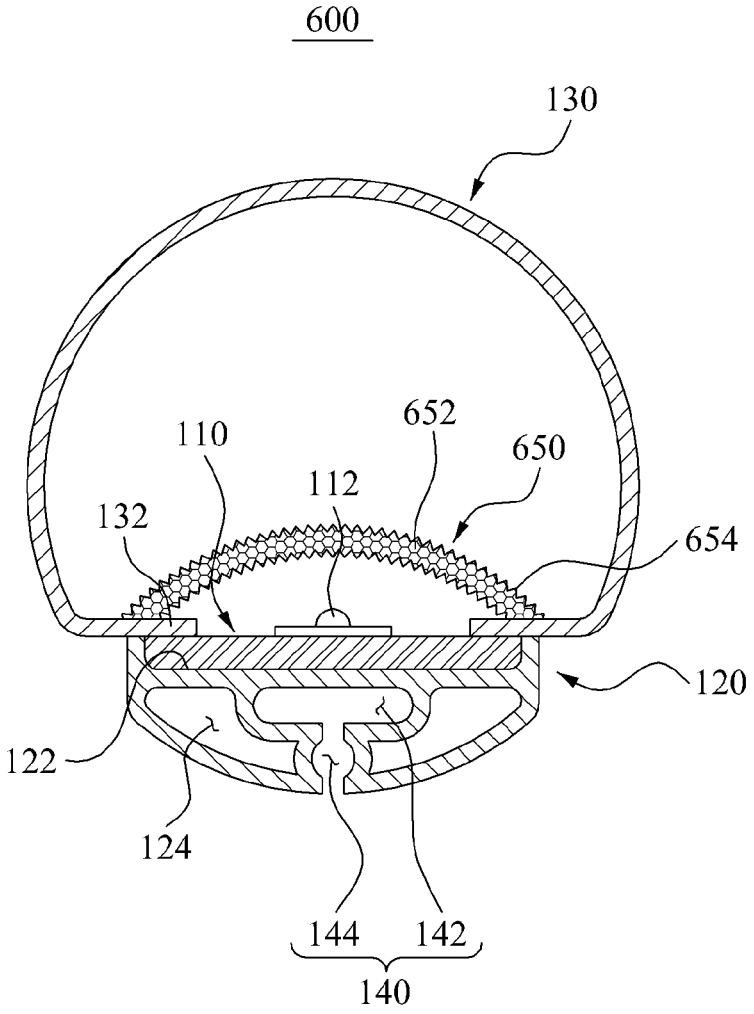

[Fig. 9]
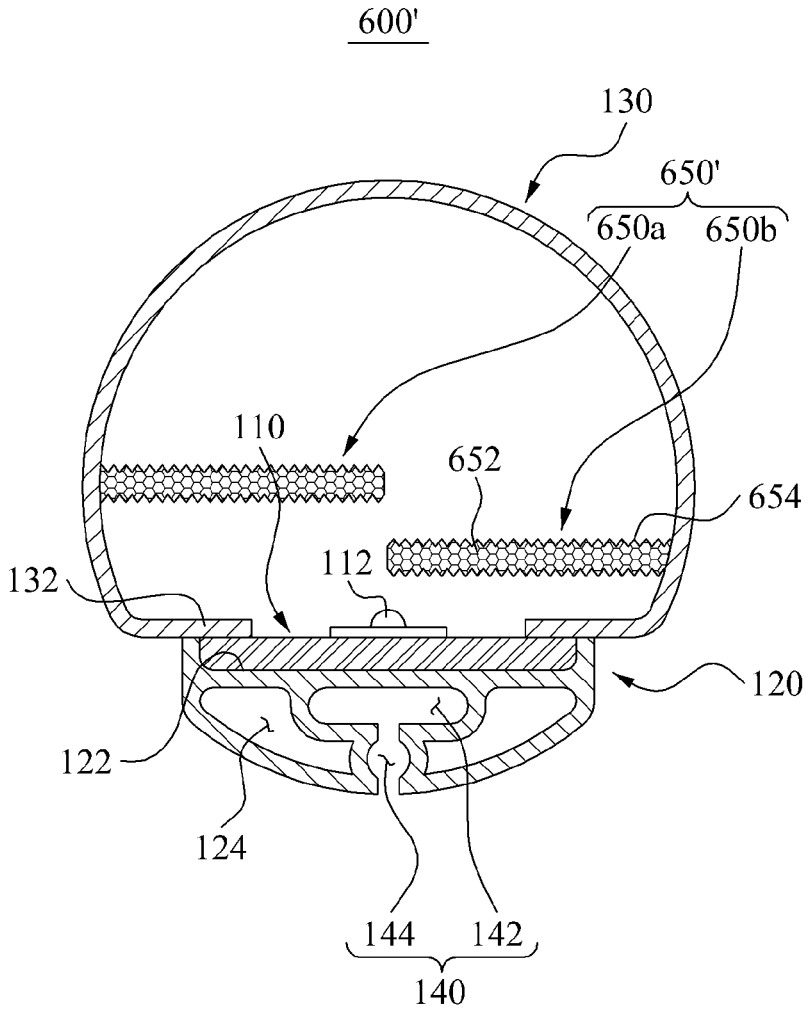

[Fig. 10]
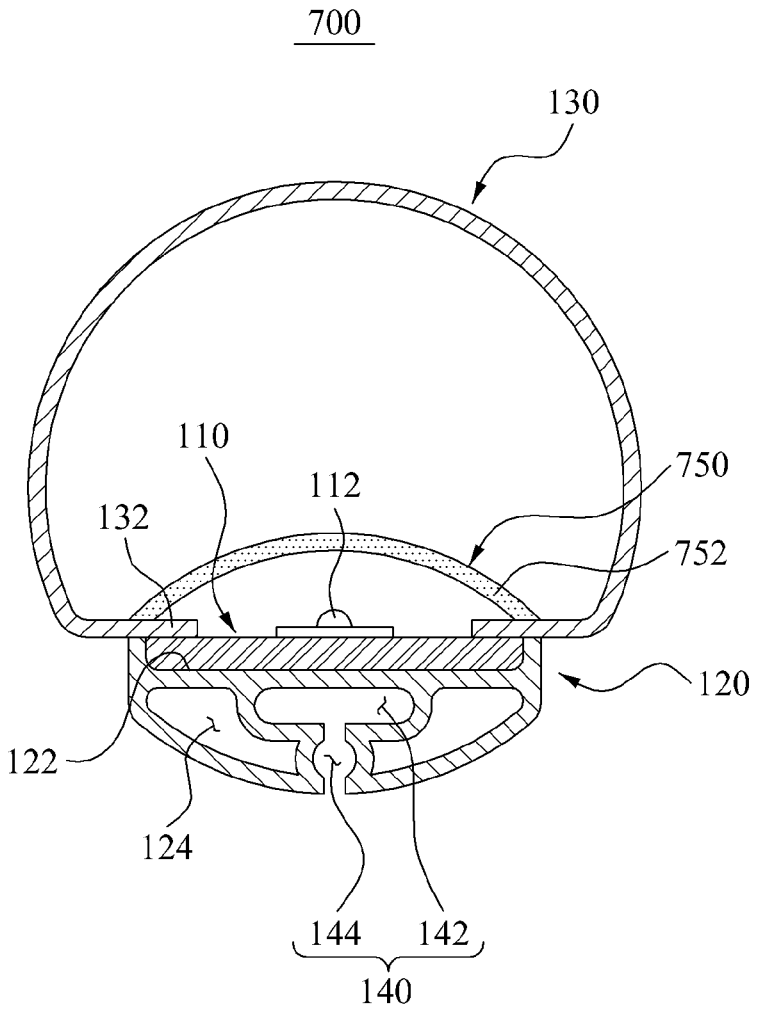

[Fig. 11]
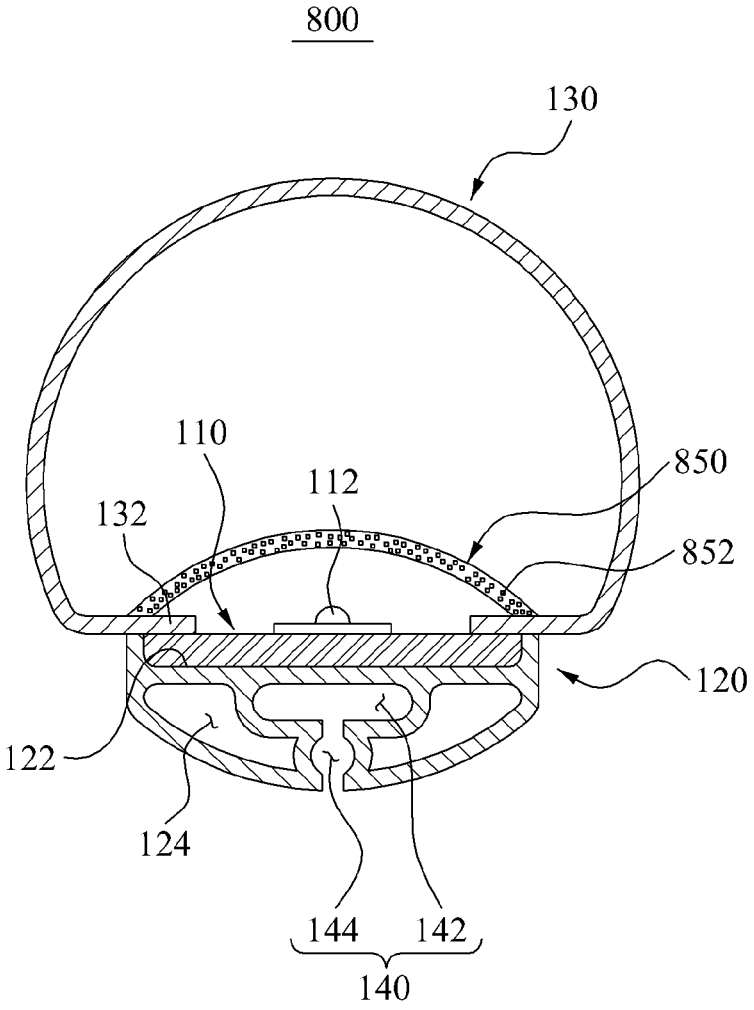

[Fig. 12]
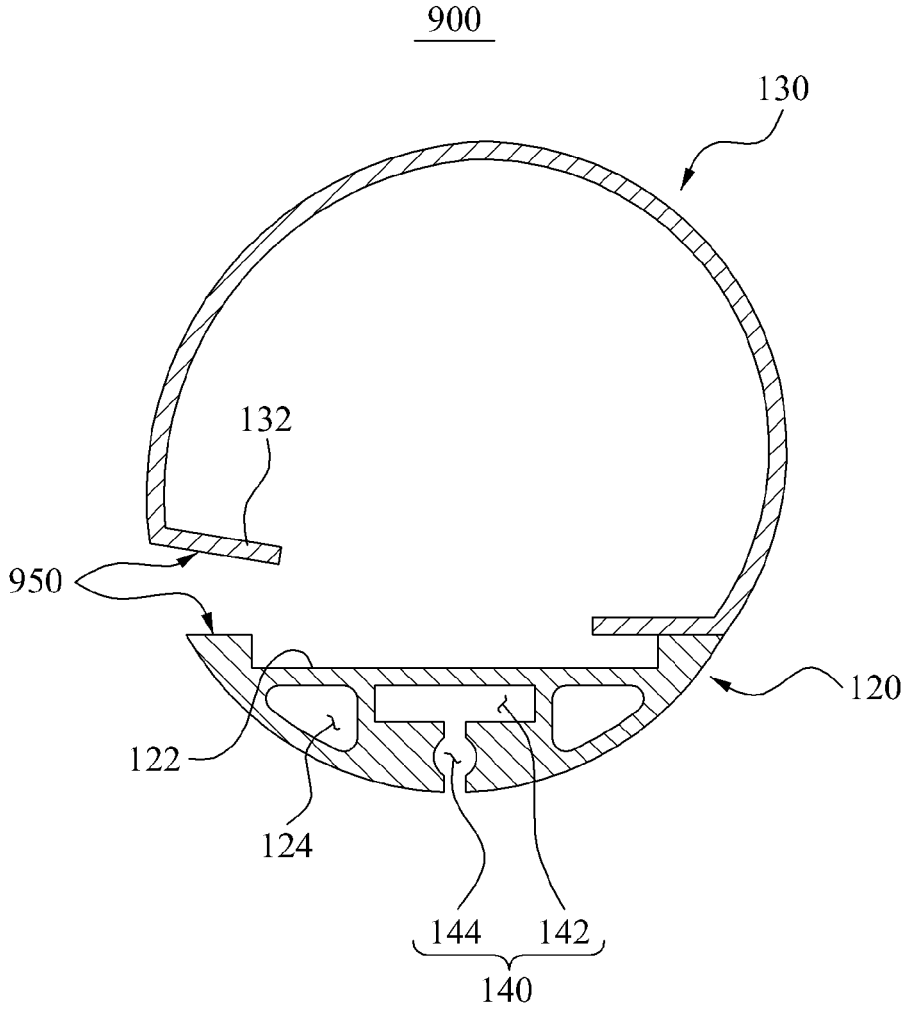

[Fig. 13]
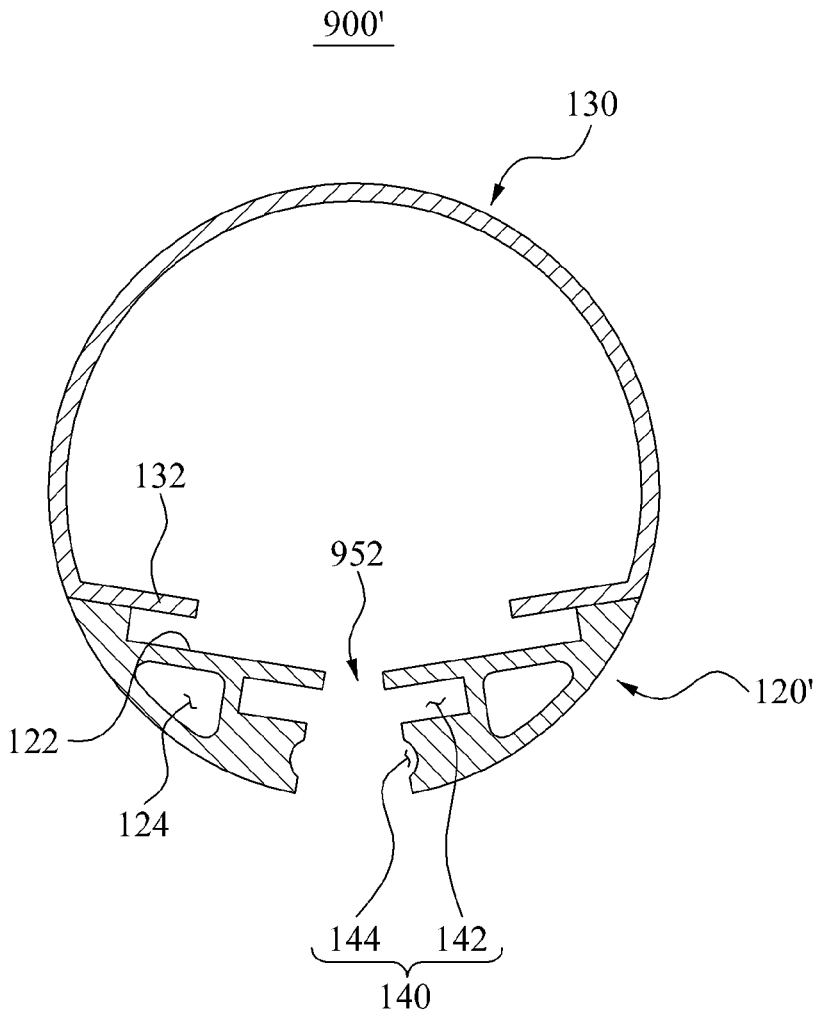

[Fig. 14]
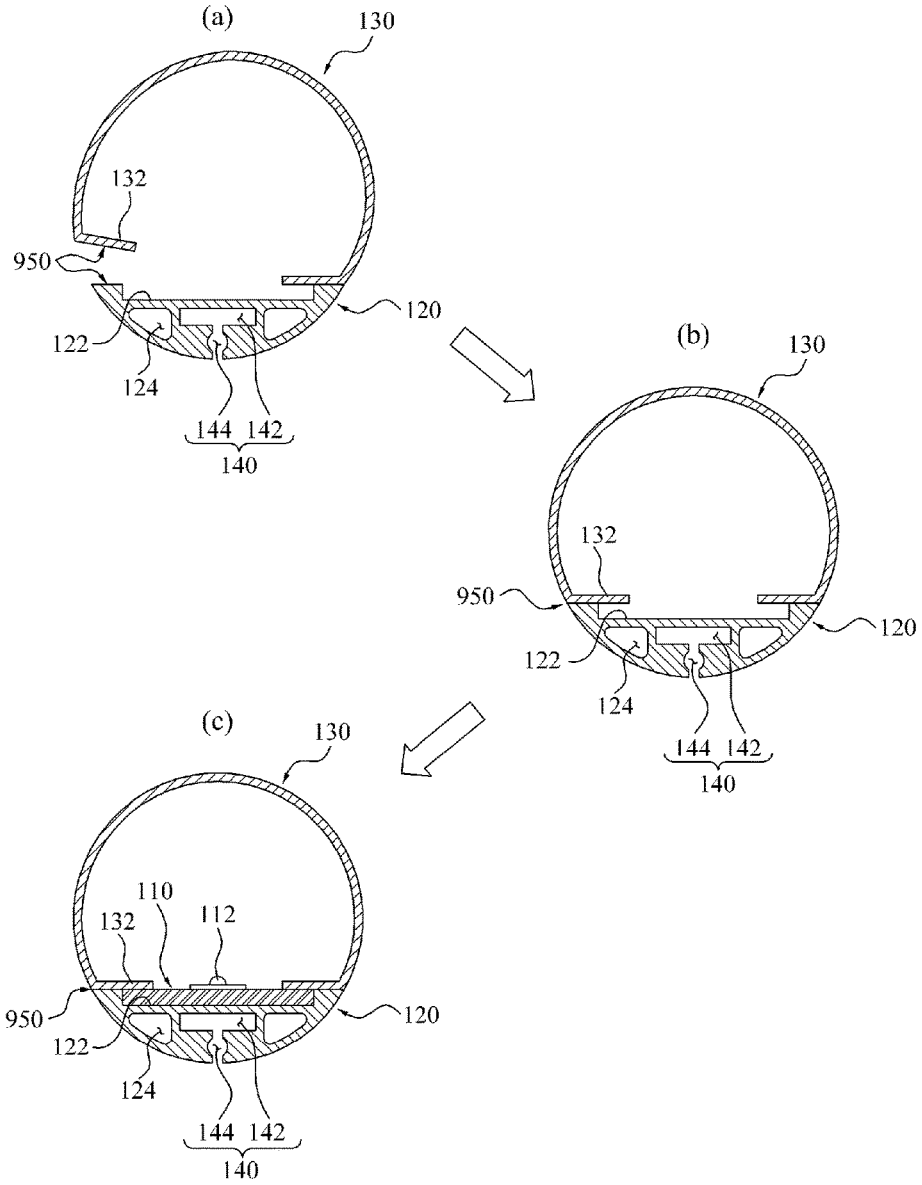

LIGHTING DEVICE AND METHOD FOR MANUFACTURING THE SAME

CROSS-REFERENCE TO RELATED APPLICATIONS

This application is a U.S. National Stage Application, which claims the benefit under 35 U.S.C. § 371 of PCT International Patent Application No. PCT/KR2013/002523, filed Mar. 27, 2013, which claims the foreign priority benefit under 35 U.S.C. § 119 of Korean Patent Application No. 10-2012-0033625, filed Mar. 30, 2012, and of Korean Patent Application No. 10-2012-0033624, filed Mar. 30, 2012, the contents of which are incorporated herein by reference.

BACKGROUND

1. Field

The present inventive concept relates to a lighting device including a light emitting diode (LED), and more particularly, to a lighting device for increasing mass productivity and reducing cost by manufacturing a heat sink and a cover by co-extrusion.

2. Description of Related Art

A light emitting diode (LED) refers to a semiconductor device that emits light as an electric current flows. For example, the LED refers to a p-n junction diode including gallium arsenic (GaAs), Ga nitride (GaN) optical semiconductors, as an electronic part that converts electrical energy to optical energy.

Recently, a blue LED and an ultraviolet (UV) LED including nitrides that have excellent physical and chemical characteristics have been introduced. Since the blue LED or UV LED may generate white light or other monochromatic lights using a phosphor material, application fields of the LED are expanding.

The LED has a relatively long life, and may be implemented in a small size and with a low weight. Also, since the LED has strong directivity of light emission, low-voltage driving is possible. In addition, the LED is durable against impact and vibration and does not require preheating and complicated driving, and therefore is applied to various uses. For example, in recent days, the application fields of the LED are expanding from small lighting for a mobile terminal to general interior and exterior lighting, vehicle lighting, a backlight unit (BLU) for a large-area liquid crystal display (LCD), and the like.

Regarding products including the LED, heat radiation is a significant issue because heat generated from the LED may seriously shorten the life of the LED.

Therefore, even in a tube-type LED lighting device, in which heat generated per unit area is relatively low compared to other general lighting devices, a heat sink is widely used to secure heat radiation performance. In conventional tube-type LED lighting devices, a heat sink and a cover are made of different materials and assembled.

SUMMARY

An aspect of the present inventive concept relates to a lighting device capable of increasing mass productivity and reducing cost by manufacturing a heat sink and a cover integrally by co-extrusion, and a manufacturing method for the same.

Another aspect of the present inventive concept encompasses a lighting device capable of controlling a seating portion of the heat sink into an accurate shape by a cooling operation of a shape control portion provided to the heat sink during extrusion of the heat sink and the cover, and a manufacturing method for the same.

Still another aspect of the present inventive concept relates to a lighting device capable of efficiently controlling characteristic of light generated from a light emitting diode (LED) according to lighting environments, design conditions, and uses of the lighting device, by including a light characteristic control portion disposed between the LED and the cover, and a manufacturing method for the same.

An aspect of the present inventive concept relates to a lighting device including a circuit substrate including a light emitting diode (LED) disposed on a first surface of the circuit substrate; a heat sink including a seating portion in which a second surface of the circuit substrate is seated; a cover connected to the heat sink such that the circuit substrate is disposed between the cover and the heat sink; and a shape control portion disposed at the heat sink around the seating portion to minutely control a shape of the seating portion by securing heat radiation performance around the seating portion.

The shape control portion may include a cooling path defined at the heat sink to uniformly guide coolant to environs of the seating portion.

The shape control portion may include a first cooling path defined in the heat sink around the seating portion; and a second cooling path defined between the outside of the heat sink and the first cooling path to supply the coolant to the inside of the first cooling path.

The second surface of the circuit substrate and the seating portion may have at least one of a curved cross section and a linear cross section to correspond to each other to make surface contact with each other.

The second surface of the circuit substrate and the seating portion may have a curved or linear cross section to correspond to each other, and a cross section of the first cooling path may have the same shape as a cross section of the seating portion such that the first cooling path is disposed in the heat sink to be parallel with the seating portion.

The cover may be made of a transparent or translucent material while the heat sink is made of a material having higher heat radiation efficiency than the material of the cover.

At least one of the cover and the heat sink may include a thermal expansion changing material that changes thermal expansion coefficients of the heat sink and the cover such that a difference in the thermal expansion coefficient is reduced.

The cover may include a foam portion disposed in at least one part of the cover to increase diffusion efficiency of light generated from the LED.

The lighting device may further include a light characteristic control portion disposed between the cover and the LED to control characteristics of light generated from the LED.

The light characteristic control portion may be integrally formed with at least one of the heat sink and the cover.

The light characteristic control portion may include a diffusion plate disposed between the cover and the LED to increase diffusion efficiency of the light generated from the LED.

The light characteristic control portion may include a fluorescent plate disposed between the cover and the LED to change a wavelength of the light generated from the LED.

The light characteristic control portion may include a filter plate disposed between the cover and the LED to remove light of a particular wavelength from the light generated from the LED.

Another aspect of the present inventive concept encompasses a lighting device. The light device includes a circuit substrate including a light emitting diode (LED) disposed on a first surface of the circuit substrate; a heat sink including a seating portion in which a second surface of the circuit substrate is seated; a cover connected to the heat sink such that the circuit substrate is disposed between the cover and the heat sink; and a shape control portion disposed at the heat sink around the seating portion to minutely control a shape of the seating portion by securing heat radiation performance around the seating portion, wherein part of at least one of the heat sink and the cover is separable such that the part is formed as a separate portion and the separate portion is connected afterward.

The separate portion as connected afterward may include any one of a bonding agent and a fastening member.

The heat sink and the cover may have a tube shape, and the separate portion may be disposed at any one side of opposite sides at which ends of the heat sink and the cover are connected.

The shape control portion may include a cooling path defined at the heat sink to uniformly guide coolant to environs of the seating portion during extrusion of the cover and the heat sink, and the separate portion may be disposed at the heat sink to separate the heat sink with respect to the cooling path.

The shape control portion may has a first cooling path defined in the heat sink to around the seating portion; and a second cooling path defined between the outside of the heat sink and the first cooling path to supply the coolant to the inside of the first cooling path.

The second surface of the circuit substrate and the seating portion may have a curved or linear cross section to correspond to each other, and a cross section of the first cooling path may have the same shape as a cross section of the seating portion such that the first cooling path is disposed in the heat sink to be parallel with the seating portion.

The second surface of the circuit substrate and the seating portion may have at least one of a curved cross section and a linear cross section to correspond to each other to make surface contact with each other.

The cover may be made of a transparent or translucent material while the heat sink is made of a material having higher heat radiation efficiency than a material of the cover, and at least one of the cover and the heat sink may be made of a deformable material to efficiently connect the separate portion.

At least one of the cover and the heat sink may include a thermal expansion changing material that changes thermal expansion coefficients of the heat sink and the cover such that a difference in the thermal expansion coefficient is reduced.

The cover may include a foam portion disposed in at least one part of the cover to increase diffusion efficiency of light generated from the LED.

The lighting device may further include a light characteristic control portion disposed between the cover and the LED to control characteristics of light generated from the LED.

The light characteristic control portion may be integrally formed with at least one of the heat sink and the cover.

The light characteristic control portion may include wings protruded from opposite inner surfaces toward a center of the cover such that ends of the wings overlap each other.

The light characteristic control portion may include a diffusion plate disposed between the cover and the LED to increase diffusion efficiency of the light generated from the LED.

The light characteristic control portion may include a fluorescent plate disposed between the cover and the LED to change a wavelength of the light generated from the LED.

The light characteristic control portion may include a filter plate disposed between the cover and the LED to remove light of a particular wavelength from the light generated from the LED.

Another aspect of the present inventive concept relates to a manufacturing method of a lighting device, the method including forming a heat sink and a cover into an elongated shape in which a part of the elongated shape is separated as a separate portion by co-extrusion. The heat sink and the cover are cut into a predetermined length. The heat sink and the cover are formed into a tube shape by connecting the separate portion of the heat sink and the cover. A circuit substrate provided with a light emitting diode (LED) is disposed on a seating portion formed at the heat sink, through open opposite ends of the heat sink and the cover. Caps are connected to the open opposite ends of the heat sink and the cover, thereby isolating an inside of the heat sink and the cover from outside air.

A shape control portion may be provided in the heat sink to minutely control a shape of the seating portion by securing heat radiation performance around the seating portion during extrusion of the cover and the heat sink. A cooling path may be provided in the shape control portion at the heat sink to flow coolant to environs of the seating portion during extrusion of the cover and the heat sink. In the forming by co-extrusion, the coolant may be introduced into the cooling path to prevent undesired deformation of the seating portion.

A lighting device and a manufacturing method for the same according to embodiments of the present inventive concept integrally form a heat sink and a cover by co-extrusion, thereby considerably increasing mass productivity of the lighting device and increasing output of the lighting device. In addition, during mass production, convenience for an operator may be improved. Consequently, the manufacturing cost may be actually reduced and price competitiveness of the lighting device may be increased.

Additionally, according to the lighting device and the manufacturing method in accordance with embodiments of the present inventive concept, a thermal expansion changing material is provided to the cover to almost equalize thermal expansion coefficients of the heat sink and the cover. Therefore, after the heat sink and the cover are formed by co-extrusion, the heat sink and the cover may be prevented from deforming during cooling.

In addition, according to the lighting device and the manufacturing method in accordance with embodiments of the present inventive concept, a seating portion of the heat sink may be formed into an accurate shape by a cooling operation of a shape control portion during extrusion of the heat sink and the cover. For example, the seating portion may be formed according to accurate design measures and a circuit substrate may be stably seated in the seating portion. In addition, since a contact area between the circuit substrate and the seating portion is increased, heat transfer performance of the circuit substrate may be improved. As a result, cooling performance for the circuit substrate may be secured and therefore overheating may be prevented.

In addition, according to the lighting device and the manufacturing method in accordance with embodiments of the present inventive concept, since a light characteristic control portion is provided between the LED and the cover to change characteristic of generated light, the characteristic of the generated light may be variably controlled using the light characteristic control portion according to the lighting environments, design conditions, or uses of the lighting device. As a result, quality and utilization of the lighting device may be improved. Also, since the light characteristic control portion is controlled according to the lighting environments, design conditions, or uses of the lighting device, there is no need to newly design another lighting device.

Furthermore, according to the lighting device and the manufacturing method in accordance with embodiments of the present inventive concept, the lighting device includes a foam portion provided to the cover to thereby increase diffusivity of light passing through the cover. In this case, a light diffusing material that used to be provided to the cover to increase the diffusivity may be omitted.

BRIEF DESCRIPTION OF DRAWINGS

FIG. 1 is a perspective view illustrating a lighting device according to an embodiment of the present inventive concept.

FIG. 2 is a perspective view illustrating main elements of the lighting device shown in FIG. 1

FIG. 3 is a sectional view illustrating main elements of the lighting device shown in FIG. 2.

FIGS. 4 to 11 are sectional views illustrating a lighting device according to embodiments of the present inventive concept.

FIGS. 12 to 13 are sectional views illustrating lighting devices according to embodiments of the present inventive concept.

FIG. 14 is a diagram illustrating a manufacturing process of the lighting device of FIG. 12.

DETAILED DESCRIPTION

Examples of the present inventive concept will be described below in more detail with reference to the accompanying drawings. The examples of the present inventive concept may, however, be embodied in different forms and should not be construed as limited to the examples set forth herein. Like reference numerals may refer to like elements throughout the specification.

FIG. 1 is a perspective view of a lighting device 100 according to an embodiment of the present inventive concept. FIG. 2 is a perspective view illustrating main elements of the lighting device 100 shown in FIG. 1. FIG. 3 is a sectional view illustrating main elements of the lighting device 100 shown in FIG. 2.

Referring to FIGS. 1 to 3, the lighting device 100 may include a circuit substrate 110, a heat sink 120, a cover 130, and a shape control portion 140.

Hereinafter, the lighting device 100 will be described as a tube-type lighting device although the lighting device 100 may be applicable to various other types.

The circuit substrate 110 (see FIGS. 2 and 3) may be in the form of a long panel having a thickness of about 0.1 mm to about 2 mm. When the thickness of the circuit substrate 110 is greater than 2 mm, mechanical strength may be increased. However, weight and price of the product may also increase. When the thickness of the circuit substrate 110 is less than 0.1 mm, mounting and handling of a light emitting diode (LED) package may be difficult. For example, width of the circuit substrate 110 ranges between about 5 mm to about 22 mm. Since a diameter of the cover 130 having a tube shape is about 26 mm, when the width is greater than 22 mm, mounting of the circuit substrate 110 may become difficult. When the width is less than 5 mm, problems may occur in relation to a surface mounting technology (SMT) and withstand voltage characteristics of an LED 112. Length of the circuit substrate 110 may be adjusted according to a size of a product.

Referring to FIG. 3, on a first surface 110*a* of the circuit substrate 110, a plurality of light emitting diodes (LEDs) 112 may be disposed. The circuit substrate 110 may include an electric circuit adapted to control operation of the plurality of LEDs 112. Exemplarily, a material having high heat radiation efficiency and high optical reflectivity may be used for the circuit substrate 110. The circuit substrate 110 may include at least one selected from a metal core printed circuit board (MCPCB), a flame retardant class 4 (FR4) PCB, a composite epoxy material (CEM) PCB, or a flexible PCB.

For example, the circuit substrate 110 may be the FR4 type. Alternatively, the circuit substrate 110 may include an organic resin material including epoxy, Triazine, silicon, polyimide, and the like, or other organic resin materials. Alternatively, the circuit substrate 110 may include ceramic materials such as silicon nitride (SiN), aluminum nitride (AlN), and aluminum oxide ($Al_2O_3$), metallic materials, and metallic compounds. Alternatively, the circuit substrate 110 may include the MCPCB. Also, the substrate 110 may be formed into various shapes by using a flexible PCB (FPCB).

An LED 112, as a light source that generates light, may be mounted on the first surface 110*a* of the circuit substrate 110 in a particular pattern. For example, the plurality of LEDs 112 may be disposed at uniform intervals, for example, about 5 mm to about 20 mm, along a length of the circuit substrate 110. When the intervals of the LEDs 112 are extremely small, the LEDs 112 may be increased in number. When the intervals of the LEDs 112 are extremely large, light of the LEDs 112 may be seen as dots, accordingly reducing quality and marketability of the product. The LEDs 112 may be a homogeneous type generating light of one same wavelength or a heterogeneous type generating light of different wavelengths.

For example, the LEDs 112 may include at least one selected from an LED emitting white light by combining a blue LED with yellow, green, red, or orange phosphors, and a violet, blue, green, red, or infrared (IR) LED. In this case, the lighting device 100 may adjust a color rendering index (CRI) from Na lighting to a level of sunlight 100. Also, the lighting device 100 may generate the white light having color temperatures from a level of candle light to a level of blue sky. In addition, the lighting device 100 may adjust a light color according to the surrounding atmosphere, by generating a visible light in violet, blue, green, red, and orange or IR. Furthermore, the lighting device 100 may generate light of a particular wavelength for promoting growth of plants.

The white light generated by combining the blue LED with yellow, green, and red phosphors or combining a green LED and a red LED may have at least two peak wavelengths. The color temperature of the white light may range from about 2000K to about 20000K. For example, a phosphor used in an LED may include composition equations and colors as follows.

Oxide system: yellow and green (Y, Lu, Se, La, Gd, Sm)3(Ga, Al)5O12:Ce, blue BaMgAl10O17:Eu, 3Sr3 (PO4)2 CaCl:Eu Silicate system: yellow and green (Ba, Sr)2SiO4:Eu, yellow and orange (Ba, Sr)3SiO5:Eu Nitride system: green β-SiAlON:Eu, yellow (La, Gd, Lu, Y, Sc)3Si6N11:Ce, orange α-SiAlON:Eu, red (Sr, Ca)AlSiN3:Eu, (Sr, Ca)AlSi(ON)3:Eu, (Sr, Ca)2Si5N8:Eu, (Sr, Ca)2Si5(ON)8:Eu, (Sr, Ba)SiAl4N7:Eu Sulfide system: red (Sr, Ca)S:Eu, (Y, Gd)2O2S:Eu, green SrGa2S4:Eu Those compositions of phosphors need to meet Stoichiometry basically. Each element may be substituted by other elements of a corresponding group of a periodic table. For example, Sr may be substituted by Ba, Ca, Mg, and the like belonging to an alkaline earth group II. Y may be substituted by Tb, Lu, Sc, Gd, and the like belonging to a Lanthanum group. Eu, which is an activator, may be substituted by Ce, Tb, Pr, Er, Yb, and the like according to a desired energy level. The activator may be applied solely or added with a sub activator to vary the property.

Although the present embodiment has been described such that the LED package is used as the LED 112, this is not limiting but various light sources may be used according to design conditions or circumstances. For example, the LED package may include an LED chip, an LED electrode, a plastic mold case, and a lens. In this case, the LED is a single product including the LED chip but not limited thereto.

Referring to FIGS. 1 to 3, the heat sink 120 may absorb heat generated from the LED 112 and radiate the heat to the outside of the lighting device 100. The heat sink 120 may include a seating portion 122 to seat a second surface 110*b* (see FIG. 3) which is an opposite surface to a first surface 110*a* of the circuit substrate 110. For example, the second surface 110*b* of the circuit substrate 110 is a surface on which the LED 112 is not mounted. The heat sink 120 may be elongated in the same manner as the circuit substrate 110. The seating portion 122 may also be elongated in the length direction of the heat sink 120.

Here, the seating portion 122 may be provided on one surface of the heat sink 120 in the form of a depression to receive the circuit substrate 110. The second surface 110*b* of the circuit substrate 110 and the seating portion 122 may have at least one of a curved cross section and a linear cross section. The second surface 110*b* and the seating portion 122 may be shaped corresponding to each other to make surface contact with each other. Therefore, heat generated from the LED 112 may be transferred to the heat sink 120 through the circuit substrate 110 and the seating portion 122.

Hereinafter, an embodiment of the present inventive concept will be descried such that the second surface 110*b* of the circuit substrate 110 and the seating portion 122 have a linear cross section. However, the present inventive concept is not limited thereto, and the second surface 110*b* and the seating portion 122 may have a curved cross section as shown in FIG. 4, or a cross section in a combined linear and curved shape.

In addition, the heat sink 120 may be made of a material having high heat radiation efficiency, for example, heat radiating resin including a high conductivity filler, such as carbon, alumina, boron nitride (BN), graphene, and the like. Also, the heat sink 120 may include a heat radiation structure for increasing the heat radiation efficiency. For example, a heat radiating fin (not separately shown in FIGS. 1-3) and a heat radiating hole 124 may be used as the heat radiation structure of the heat sink 120. By employing the heat radiating fin and the heat radiating hole 124, a contact area between the heat sink 120 and outside air may be increased. Consequently, the amount of heat radiated from the heat sink 120 to the outside air may be increased. Furthermore, since sufficient heat radiation is secured without increasing size of the heat sink 120, material cost and weight of the heat sink 120 may be reduced.

Referring to FIGS. 1 to 3, the cover 130 may be a member allowing transmission of the light generated from the LED 112, being configured to surround the seating portion 122. The cover 130 may be provided in a tube shape. An opening may be extended at one side of the cover 130 in a length direction of the cover 130. For example, the cover 130 may be in a tube shape having a C-shape cross section. The heat sink 120 may be disposed at the opening of the cover 130. Here, the seating portion 122 of the heat sink 120 may be disposed at the opening of the cover 130.

Here, the opening of the cover 130 may be smaller than the seating portion 122. A cover end 132 defining the opening of the cover 130 may interfere with the first surface 110*a* of the circuit substrate 110 seated in the seating portion 122. Therefore, escape of the circuit substrate 110 from the seating portion 122 may be prevented. As a result, the circuit substrate 110 may be slid into the seating portion 122 through open opposite ends of the cover 130 and the heat sink 120.

The opposite ends of the cover 130, opened in a length direction, may be each provided with a cap 102 (see FIG. 1). The caps 102 may prevent the circuit substrate from escaping from the seating portion 122 through the opposite ends of the cover 130, opened in the length direction. Therefore, the circuit substrate 110 is received in a hermetic space defined by the heat sink 120, the cover 130, and the caps 102. Each of the caps 102 may include a power pin 104 (see FIG. 1) through which external power is inputted. The power inputted through the power pin 104 may be transmitted to the LED 112 through the circuit substrate 110.

For example, the caps 102 may be mounted to opposite ends of the cover 130 and the heat sink 120. The caps 102 may each include a power pin 104 electrically connected with the LED 112.

Alternatively, any one of the caps 102 may include the power pin 104 electrically connected with the LED 112 while another one of the caps 102 includes a dummy pin which is electrically open or short-circuited to a ground. In addition, the cap 102 may include an optical sensor module including a sensor detecting surrounding luminosity. When the optical sensor module is provided to the cap 102, the optical sensor module may calculate surrounding illumination by detecting the surrounding luminosity, and control emission and luminosity of the LED 112 using the surrounding luminosity.

According to an embodiment of the present inventive concept, the cover 130 and the heat sink 120 may be integrally formed with each other by extrusion. For example, the cover 130 and the heat sink 120 may be made of an extrudable material such as heat radiating resin. After co-extrusion, the cover 130 and the heat sink 120 may be integrally bonded to each other in a molten state.

The cover 130 may be made of a transparent or translucent extrudable material. For example, the cover 130 may be made of a transparent or translucent material having transmittance of about 50% or higher so that the light generated from the LED 112 may smoothly pass through. For example, the cover 130 may be made of transparent plastic or translucent plastic such as polycarbonate (PC) or PC including a dispersing agent.

The heat sink 120 may be made of an extrudable material having higher heat radiation efficiency than the material of the cover 130. For example, the heat sink 120 may be made of heat radiating resin including a high conductivity filler so as to radiate the heat generated from the LED 112 to the outside. For example, the heat sink 120 may be made of resin which includes a filler, for example PC including a high conductivity filler, to increase heat conductivity. A carbon filter, an aluminum filler, a graphite filler, a ceramic filler, or the like may be used as the filler.

As aforementioned, when the cover 130 and the heat sink 120 are made of different materials from each other, thermal expansion rates of the cover 130 and the heat sink 120 may be different. Therefore, the cover 130 and the heat sink 120 may be undesirably deformed during the extrusion. To avoid such undesirable deformation, at least one of the cover 130 and the heat sink 120 may be provided with a thermal expansion changing material (not separately shown) that changes the thermal expansion coefficient. By the thermal expansion changing material, property of the cover 130 may be changed to have a thermal expansion coefficient similar or identical to a thermal expansion coefficient of the heat sink 120. The thermal expansion changing material may include an inorganic filler or glass fiber capable of changing the thermal expansion coefficient. For example, titanium dioxide ($TiO_2$), barium sulfate ($BaSO_4$), silicon dioxide ($SiO_2$), or the like may be used as the inorganic filler.

Referring to FIGS. 1 to 3, the shape control portion 140 may minutely control a shape of the seating portion 122, by securing sufficient heat radiation efficiency around the seating portion 122 during the extrusion of the cover 130 and the heat sink 120. For example, in cooling of the heat sink 120 after the extrusion, since cooling speed is varied according to thickness and position of the heat sink 120, the seating portion 122 may be deformed rather than maintaining a fixed shape.

Actually, even though the heat sink 120 is made of resin having high heat radiation efficiency, cooling efficiency of the heat sink 120 may be reduced during the extrusion in comparison to when a metallic material is used, due to limits of the resin. Therefore, the shape control portion 140 may be added to the heat sink 120 so as to secure the cooling efficiency around the seating portion 122 during the extrusion. Therefore, the seating portion 122 may be quickly cooled, thereby being prevented from deformation. For example, when the shape control portion 140 is applied to the heat sink 120, the heat sink 120 may be made of heat radiating resin which costs lower than metal.

Thus, when the shape of the seating portion 122 is minutely controlled by the shape control portion 140, the seating portion 122 may be formed in optimal design measures. Accordingly, a contact area between the circuit substrate 110 and the seating portion 122 may be prevented from being reduced due to deformation of the seating portion 122. In addition, since a heat transfer area between the seating portion 122 and the circuit substrate 110 is secured, the heat generated from the LED 112 may be favorably radiated.

The shape control portion 140 may include cooling paths 142 and 144 (see FIG. 3) for coolant, formed in the heat sink 120. The cooling paths 142 and 144, referring to paths for guiding the coolant to environs of the seating portion 122, may be disposed in the extruded heat sink 120 to surround the seating portion 122.

For example, the shape control portion 140 may include a first cooling path 142 disposed at a predetermined distance from the seating portion 122, and a second cooling path 144 configured to supply the coolant into the first cooling path 142. The first cooling path 142 may be arranged around a lower surface of the seating portion 122. The first cooling path 142 may have a smaller width than a width of the seating portion 122 and may be laterally symmetrical. The second cooling path 144 may be disposed between the outside of the heat sink 120 and the first cooling path 142 to fluidly communicate with the first cooling path 142.

As shown in FIGS. 2 and 3, the second surface 110*b* of the circuit substrate 110 and the seating portion 122 may be shaped to correspond to each other and to have a linear cross section to make surface contact with each other. Part of the first cooling path 142 may be disposed right under the seating portion 122 in the heat sink 120.

In detail, the second surface 110*b* of the circuit substrate 110 may be in the form of a substantially rectangular plane. Also, the seating portion 122 may be in the form of a substantially rectangular plane, in the same manner as the second surface 110*b*.

The first cooling path 142 may be in the form of a flat plate space with a predetermined thickness, defined in the heat sink 120. The first cooling path 142 may be disposed right under the seating portion 122. The first cooling path 142 may have a surface area smaller than or equal to a surface area of the seating portion 122. In an embodiment of the present inventive concept, the first cooling path 142 has a smaller surface area than the seating portion 122.

The second cooling path 144 may be disposed at a lower portion of the first cooling path 142. The second cooling path 144 may extend in a direction normal to the first cooling path 142. For example, the first cooling path 142 and the second cooling path 144 may form a substantially T-shape cross section. One end of the second cooling path 144 may fluidly communicate with a middle of the first cooling path 142. The other end of the second cooling path 144 may be opened to an outer surface of the heat sink 120 so as to be opened outward.

Accordingly, during the extrusion of the heat sink 120 and the cover 130, the coolant may be introduced into the second cooling path 144 and flow to the first cooling path 142, thereby efficiently cooling the environs of the seating portion 122. Furthermore, the first cooling path 142 and the second cooling path 144 may operate as a heat radiation structure for the heat sink 120 when the lighting device 100 is in use. For example, the first cooling path 142 and the second cooling path 144 may increase a heat transfer area of the heat sink 120 contacting the outside air. As a result, heat radiation efficiency using the heat sink 120 may be increased when the lighting device 100 is in use.

In the heat sink 120, the heat radiating hole 124 may be formed at a portion in which the shape control portion 140 is not formed. The heat radiating hole 124 may be provided to increase a contact area between the heat sink 120 and an external air, as a structure independent from the shape control portion 140 so as not to fluidly communicate with the shape control portion 140. Therefore, during co-extrusion of the heat sink 120 and the cover 130, coolant may not flow into the heat radiating hole 124 from the shape control portion 140.

FIG. 4 is a sectional view of a lighting device 200 according to another embodiment of the present inventive concept. In FIG. 4, like reference numerals as in FIGS. 1 to 3 refer to like elements. Hereinafter, a description will be made about differences of the lighting device 200 from the lighting device 100 of FIGS. 1 to 3.

FIG. 4 shows the lighting device 200 in which a second surface 210*b* of a circuit substrate 210 and a seating portion 222 of a heat sink 220 are shaped to have a curved cross section. Referring to FIG. 4, the second surface 210*b* of the circuit substrate 210 and the seating portion 222 may be shaped to correspond to each other through the curved sectional surfaces. In addition, a first cooling path 242 of a shape control portion 240 may also have a curved cross section corresponding to the shape of the seating portion 222. The shape control portion 240 may also include a second cooling path 244.

As aforementioned, although the circuit substrate 210 and the seating portion 222 have cross sections in other than linear shapes, the shape of the seating portion 222 may be minutely controlled by the shape control portion 240 during the extrusion of the heat sink 120 and the cover 130. Therefore, the shapes of the circuit substrate 210 and the seating portion 222 may be varied according to design conditions and circumstances of the lighting device 200.

FIGS. 5 and 6 are sectional views of lighting devices 300 and 400 according to other embodiments of the present inventive concept. In FIGS. 5 and 6, like reference numerals as in FIGS. 1 to 3 refer to the like elements. Hereinafter, a description will be made about differences of the lighting devices 300 and 400 from the lighting device 100 of FIGS. 1 to 3.

FIGS. 5 and 6 illustrate the lighting devices 300 and 400 respectively including heat sinks 320 and 420 in various structures.

Referring to FIG. 5, in the lighting device 300 of FIG. 5, an outer surface of the heat sink 320 may have the same curvature as the cover 130 so that the lighting device 300 is provided in a tube shape as a whole. When the heat sink 320 is formed in this manner, the heat sink 320 may have the same structure as conventional fluorescent lamps and therefore easily replace the conventional fluorescent lamps.

Referring to FIG. 6, in the lighting device 400 of FIG. 6, a heat radiation structure of a heat sink 420 of the lighting device 400 is different from in the lighting device 100 shown in FIGS. 2 and 3. For example, the heat sink 420 in FIG. 6 has a box form with one side opened. A seating portion 422 to seat the circuit substrate 110 may be formed in the heat sink 420.

Here, an opening of the heat sink 420 may be formed smaller than the circuit substrate 110. Therefore, a heat sink end 424 defining the opening of the heat sink 420 may prevent escape of the circuit substrate 110. Thus, different from in the lighting device 100 shown in FIGS. 2 and 3, according to an embodiment of the present inventive concept, the cover end 132 defining the opening of the cover 130 may not have to interfere with the circuit substrate 110.

In addition, a plurality of heat radiating fins 426 may be provided on a rear surface of the heat sink 420. A heat transfer area of the heat sink 420 may be increased by the plurality of heat radiating fins 426, thereby increasing the heat radiation efficiency.

In particular, shape control portions 440 may be provided in a recess form between the plurality of heat radiating fins 426. For example, during extrusion of the heat sink 420 and the cover 130, coolant may flow into environs of the seating portion 422 through the shape control portions 440 formed between the plurality of heat radiating fins 426. Thus, according to an embodiment of the present inventive concept, the shape control portion 440 may be conveniently formed during forming of the plurality of heat radiating fins 426, rather than being separately formed in a particular shape.

FIG. 7 is a sectional view of a lighting device 500 according to still another embodiment of the present inventive concept. In FIG. 7, like reference numerals as in FIGS. 1 to 3 refer to like elements. Hereinafter, a description will be made about differences of the lighting device 500 from the lighting device 100 of FIGS. 1 to 3.

FIG. 7 shows the lighting device 500 which includes a cover 530 provided with a foam portion 532. For example, as shown in FIG. 7, the foam portion 532 having a foamed structure may be disposed in at least one part of the cover 530.

The foam portion 532 may include a plurality of structure bodies each including air bubbles. The foam portion 532 may be formed in at least one part of the cover 530 by applying a foaming technology during extrusion of the cover 530.

The foaming technology refers to a method of manufacturing a product, by generating foam during shaping and then evenly distributing the foam in polymer resin. For example, resin may be mixed with a foaming agent and other additives in advance, or a foaming agent may be injected by a pump (not separately shown) from a proper position of an extruder (not separately shown) and then evenly distributed. Next, therefore, when an extrusion object is extruded through a die of the extruder, the foaming agent in a compressed state may expand immediately and generate foam. Therefore, the foaming technology may increase weight reduction efficiency, heat insulation efficiency, sound absorption efficiency, impact resistance, and the like. In particular, when the foaming technology is applied to a light transmitting object, diffusivity of the light may be increased. Hereinafter, an embodiment of the present inventive concept will be described to include the foam portion 532 formed through the entire part of the cover 530.

The foam portion 532 may diffuse light passing through the cover 530. When diffusivity of the light is increased by the foam portion 532, light distribution efficiency of the lighting device 500 may be increased. Especially, whereas light diffusing materials such as $TiO_2$ are added to a cover to secure the light diffusivity in the conventional lighting devices, since an embodiment of the present inventive concept secures the light diffusivity using the foam portion 532, the light diffusing materials may be omitted from the cover 530.

FIGS. 8 to 11 are sectional views illustrating lighting devices 600, 600', 700, and 800 according to other embodiments of the present inventive concept. In FIGS. 8 to 11 like reference numerals as in FIGS. 1 to 3 refer to like elements. Hereinafter, a description will be made about differences of the lighting devices 600, 600', 700, and 800 from the lighting device 100 of FIGS. 1 to 3.

Referring to FIGS. 8 to 11, the lighting devices 600, 600', 700, and 800 are distinctive from the lighting device 100 shown in FIGS. 1 to 3 in that light characteristic control portions 650, 650', 750, and 850 are further provided, respectively, being disposed between the cover 130 and the LED 112 to control characteristics of the light generated from the LED 112.

The light characteristic control portions 650, 650', 750, and 850 may be integrally formed with at least one of the heat sink 120 and the cover 130, by extrusion. In addition, the light characteristic control portions 650, 650', 750, and 850 may be made of a transparent or translucent material to allow transmission of the light generated from the LED 112.

Here, the light characteristic control portions 650, 650', 750, and 850 may be made of the same material as the cover 130 or the heat sink 120. The light characteristic control portions 650, 650', 750, and 850 may be extruded integrally with the cover 130 or the heat sink 120, or may be made of the same material as the cover 130 and the heat sink 120 and attached to the cover 130 or the heat sink 120.

Alternatively, the light characteristic control portions 650, 650', 750, and 850 may be made of a different material from the cover 130 and the heat sink 120. In this case, the light characteristic control portions 650, 650', 750, and 850 may be co-extruded with any one of the cover 130 and the heat sink 120, or may be made of a different material from the cover 130 and the heat sink 120 and attached to the cover 130 or the heat sink 120.

Hereinafter, for convenience in explanation, the light characteristic control portions 650, 650', 750, and 850 will be described to be extruded together with the cover 130 using the same material as the cover 130. For example, the light characteristic control portions 650, 650', 750, and 850 may be extruded together with the cover 130 during co-extrusion of the cover 130 and the heat sink 120.

The light characteristic control portions 650, 650', 750, and 850 may be provided in various shapes and positions so that the light generated from the LED 112 always passes through the light characteristic control portions 650, 650', 750, and 850. For example, the light characteristic control portions 650, 750, and 850 shown in FIGS. 8, 10, and 11 may be provided in a dome shape covering the circuit substrate 110 while extending in a length direction of the circuit substrate 110.

However, the light characteristic control portion 650' shown in FIG. 9 may be provided in the form of wings protruding from opposite inner surfaces of the cover 130 toward a center of the cover 130, and may be elongated in the length direction of the circuit substrate 110. In this case, opposite ends of the light characteristic control portion 650' may overlap each other. As shown in FIG. 9, the light characteristic control portion 650' may be disposed at each of opposite ends of the cover 130. During connection of each of the separate portions 950 and 952 (see FIGS. 12 and 13) of the heat sink 120 and the cover 130, the cover 130 may be elastically deformed without interference with the light characteristic control portion 650'.

However, the shape of the light characteristic control portions 650, 650', 750, and 850 is not limited to the embodiments shown in FIGS. 8 to 11 but may be varied according to the design conditions and lighting circumstances.

FIGS. 8 and 9 illustrate the lighting devices 600 and 600' including diffusion plates 650 and 650', respectively, as the light characteristic control portion, to increase diffusivity of the light generated from the LED 112. The diffusion plates 650 and 650' may be disposed between the cover 130 and the LED 112. Therefore, the light generated from the LED 112 may be diffused by the diffusion plates 650 and 650' and reach the cover 130.

The diffusion plates 650 and 650' may include at least one of fine air bubbles to diffuse the light generated from the LED 112 and a reflection medium to reflect the light. Furthermore, a serration 654 may be provided to a surface of the diffusion plates 650 and 650' to diffuse the light generated from the LED 112.

Hereinafter, the embodiments will be described to include a foam portion 652 including fine air bubbles formed at the diffusion plates 650 and 650', and the serration 654 formed on the surface of the diffusion plates 650 and 650'. However, the present inventive concept is not limited thereto, and various other materials capable of increasing diffusivity of light may be added to the diffusion plates 650 and 650' or a light diffusion structure may be applied to the diffusion plates 650 and 650'. For example, high-reflective resins may be provided to the diffusion plates 650 and 650' to increase diffusivity.

When the light characteristic control portion includes the diffusion plates 650 and 650' as described above, since diffusivity of the light generated from the LED 112 is increased, light distribution efficiency of the lighting devices 600 and 600' may be increased. For example, the hot spot phenomenon, in which the light of a plurality of the LEDs 112 arranged at uniform intervals is emitted to the outside in the form of a point light source, may be prevented.

Accordingly, the light diffusion structure or light diffusing material that used to be provided to the cover 130 may be omitted. In addition, since the diffusion plates 650 and 650' take a smaller surface area than the cover 130, the quantity of the light diffusing material used may be reduced compared to when the light diffusing material is applied to the cover 130.

In particular, the diffusion plate 650 shown in FIG. 8 is configured to totally partition an inner space of the cover 130 and surround the LED 112. The diffusion plate 650' shown in FIG. 9 may be configured to allow transmission of the entire of the light generated from the LED 112, without separating the inner space of the cover 130 into two.

Here, the diffusion plate 650' of FIG. 9 may be divided into a left diffusion plate **650*a* and a right diffusion plate 650*b*. The left diffusion plate 650*a* may be protruded from a left inner surface of the cover 130 toward the right by a predetermined length. The right diffusion plate 650*b* may be protruded from a right inner surface of the cover 130 toward the left by a predetermined length. The left diffusion plate 650*a* and the right diffusion plate 650*b* may be disposed in different positions to alternate each other. For example, the left diffusion plate 650*a* and the right diffusion plate 650*b* may be configured such that the light generated from the LED 112 may pass through only one of the left diffusion plate 650*a* and the right diffusion plate 650*b***.

FIG. 10 illustrates the lighting device 700 including a fluorescent plate 750 as the light characteristic control portion to change a wavelength of the light generated from the LED 112. The fluorescent plate 750 may be disposed between the cover 130 and the LED 112. Therefore, the wavelength of the light generated from the LED 112 may be changed by the diffusion plates 650 and 650' and the light may reach the cover 130.

The fluorescent plate 750 may include a plurality of fluorescent mediums 752 to variably change the wavelength of the light generated from the LED 112. Therefore, color of the light distributed by the lighting device 700 may be controlled easily by varying combination of the plurality of fluorescent mediums 752.

When the light characteristic control portion 750 includes the fluorescent plate 750 as aforementioned, color of the light may be selectively controlled according to different uses and environments of the lighting device 700, thereby improving utilization of the lighting device 700. In addition, since the fluorescent plate 750 takes a smaller surface area than the cover 130, the quantity of the fluorescent material used may be reduced compared to when the fluorescent material is added to the cover 130.

FIG. 11 illustrates the lighting device 800 including a filter plate 850 as the light characteristic control portion to remove light of a particular wavelength from the light generated from the LED 112. The filter plate 850 may be disposed between the cover 130 and the LED 112. Therefore, the light generated from the LED 112, from which the light of the particular wavelength is removed by the filter plate 850, may reach the cover 130.

The filter plate 850 may include a plurality of filter mediums 852 to block the light of the particular wavelength of the light generated from the LED 112. Therefore, a wavelength of the light distributed by the lighting device 800 may be easily controlled by selectively using the plurality of filter mediums 852.

When the light characteristic control portion includes the filter plate 850 as described above, the wavelength of the light may be selectively set. Therefore, utilization of the lighting device 800 may be improved. For example, the lighting device 800 may be used as an agricultural lighting device that provides light of a particular wavelength necessary for growth of plants, or an industrial lighting device that provides light of a particular wavelength necessary for manufacturing a semiconductor. In addition, since the filter plate 850 takes a smaller surface area than the cover 130, the quantity of the filter mediums used may be reduced compared to when the filter mediums are added to the cover 130.

FIGS. 12 to 13 are sectional views illustrating lighting devices 900 and 900' according to other embodiments of the present inventive concept. FIG. 14 is a diagram illustrating a manufacturing process of the lighting device 900 of FIG. 12.

Referring to FIGS. 12 to 14, part of at least one of the heat sink 120 and the cover 130 of the lighting device 900 may be formed as a separate portion, for example, separate portions 950 and 952. Each of the separate portions 950 and 952 may be connected. Here, the heat sink 120 and the cover 130 may be formed by co-extrusion.

For example, the heat sink 120 and the cover 130 may be co-extruded such that at least one of the heat sink 120 and the cover 130 is partly separated. Each of the separate portions 950 (see FIG. 12) and 952 (see FIG. 13), formed at the heat sink 120 or the cover 130, may be connected in various manners after the extrusion of the heat sink 120 and the cover 130 is completed.

For example, each of the separate portions 950 and 952 may be connected using any one of a bonding agent and a fastening member. Hereinafter, for convenience in explanation, each of the separate portions 950 and 952 according to an embodiment of the present inventive concept will be described to be bonded by a bonding agent. However, the present inventive concept is not limited thereto, and various methods may be applied according to design conditions and circumstances of the lighting device 900.

FIGS. 12 and 13 show embodiments of the separate portions 950 and 952 in various configurations. However, configuration of the separate portions 950 and 952 is not limited to the embodiments shown in FIGS. 12 and 13 but may be varied according to the design conditions and circumstances of the lighting device 900.

Referring to FIG. 12, the heat sink 120 and the cover 130 may be provided in a tube shape. The separate portion 950 may be disposed at any one side of opposite sides at which ends of the heat sink and the cover are connected. For example, the heat sink 120 and the cover 130 may be extruded with ends of one side thereof being interconnected, and, during the extrusion, ends of the other side of the heat sink 120 and the cover 130 may be separated.

When extrusion of the heat sink 120 and the cover 130 is completed, the separate portion 950 formed at the ends of the other sides of the heat sink 120 and the cover 130 may be connected, thereby completing the heat sink 120 and the cover 130 into the tube shape.

Referring to FIG. 13, the separate portion 952 may be provided at a heat sink 120' in such a manner that the heat sink 120' is separated with respect to the cooling paths 142 and 144 of the shape control portion 140. For example, the heat sink 120' may be extruded into two pieces separated by the separate portion 952. In addition, the two separate pieces of the heat sink 120' may be extruded in a state of being connected to opposite ends of the cover 130, respectively.

After extrusion of the heat sink 120 and the cover 130 is thus completed, the separate portion 952 of the heat sink 120' may be connected, thereby completing the heat sink 120' and the cover 130 into the tube shape.

Therefore, referring to FIGS. 12 and 13, at least one of the cover 130 and the heat sink 120 may be made of resin deformable to efficiently interconnect each of the separate portions 950 and 952. Therefore, when the heat sink 120 is extruded to include each of the separate portions 950 and 952, at least one of the cover 130 and the heat sink 120 may be elastically or plastically deformed during connection of each of the separate portions 950 and 952. Therefore, breakage of the heat sink 120 of the cover 130 may be prevented during connection of each of the separate portions 950 and 952. Also, connection of each of the separate portions 950 and 952 may be facilitated.

A manufacturing method for the lighting device 900 according to an embodiment of the present inventive concept will be described. Hereinafter, the manufacturing method for the lighting device 900 including the separate portion 950 shown in FIG. 12 will be described with reference to FIG. 14.

Referring to (a) of FIG. 14, the heat sink 120 and the cover 130 may be formed in an elongated shape by co-extrusion.

Here, the separate portion 950 is provided to the ends of one side of the heat sink 120 and the cover 130. Coolant (not separately shown) may be introduced into the shape control portion 140 of the heat sink 120. Therefore, undesired deformation of the seating portion 122 may be prevented during co-extrusion of the heat sink 120 and the cover 130. As a consequence, the shape of the seating portion 122 may be controlled to be in accurate design measures.

The heat sink 120 and the cover 130 formed as aforementioned may be cut into a predetermined length. For example, since the lighting device 900 may be set to a standard size, the heat sink 120 and the cover 130 may be properly cut according to the standard size of the lighting device 900.

Referring to (b) of FIG. 14, the separate portion 950 of the heat sink 120 and the cover 130 is connected, thereby completing the heat sink 120 and the cover 130 into the tube shape.

For example, the separate portion 950 may be securely bonded using a bonding agent. Therefore, the heat sink 120 and the cover 130 may be formed into the tube shape with opposite ends opened.

Referring to (c) of FIG. 14, the circuit substrate 110 may be slid into the seating portion 122 of the heat sink 120 through the opened opposite ends of the heat sink 120 and the cover 130.

After the circuit substrate 110 is seated on a right position of the seating portion 122, the caps 102 may be connected to the opposite ends of the heat sink 120 and the cover 130, thus completing the lighting device 900. Accordingly, the inside of the space defined by the heat sink 120, the cover 130, and the caps 102 may be isolated from the outside air.

Although a few exemplary embodiments of the present inventive concept have been shown and described, the present inventive concept is not limited to the described exemplary embodiments. Instead, it would be appreciated by those skilled in the art that changes may be made to these exemplary embodiments without departing from the principles and spirit of the inventive concept, the scope of which is defined by the appended claims and their equivalents.

The invention claimed is:

1. A lighting device, comprising:

a circuit substrate including a light emitting diode (LED) disposed on a first surface of the circuit substrate;

a heat sink including a seating portion in which a second surface of the circuit substrate is seated;

a cover connected to the heat sink such that the circuit substrate is disposed between the cover and the heat sink, a part of at least one of the heat sink and the cover is separable such that the part forms a separate portion for coupling;

a shape control portion provided below the seating portion and, the shape control portion being configured to control a shape of the seating portion by securing heat radiation performance around the seating portion, the shape control portion including:

a first cooling path provided with a cross section that is extended laterally parallel to a width of the seating portion, the first cooling path being disposed at the heat sink around the seating portion; and a second cooling path configured to fluidly communicate with a middle of the first cooling path and an outside of the heat sink, the second cooling path being defined between the outside of the heat sink and the first cooling path to supply coolant to an inside of the first cooling path during co-extrusion of the heat sink and the cover, the second cooling path being disposed at a lower portion of the first cooling path such that the first cooling path and the second cooling path form a T-shape cross section; and at least one heat radiating hole formed in the heat sink at a portion other than a portion in which the first cooling path and the second cooling path of the shape control portion are formed, wherein the separate portion is disposed at the heat sink in such a manner that the heat sink is separated with respect to the first cooling path and the second cooling path, thereby forming two separate pieces of the heat sink connected to opposite ends of the cover, respectively, wherein while the two separate pieces of the separate portion are connected, the at least one heat radiating hole is formed independent of a fluid communication of the first cooling path and the second cooling path of the shape control portion.

2. The lighting device of claim 1, wherein the first cooling path uniformly guides the coolant to environs of the seating portion.

3. The lighting device of claim 1, wherein the second surface of the circuit substrate and the seating portion have at least one of a curved cross section and a linear cross section to correspond to each other to make surface contact with each other.

4. The lighting device of claim 1, wherein the second surface of the circuit substrate and the seating portion have a curved or linear cross section to correspond to each other, and the cross section of the first cooling path has the same shape as a cross section shape of the seating portion.

5. The lighting device of claim 1, wherein the cover is made of a transparent or translucent material while the heat sink is made of a material having higher heat radiation efficiency than the transparent or translucent material of the cover.

6. The lighting device of claim 5, wherein at least one of the cover and the heat sink comprises a thermal expansion changing material that changes thermal expansion coefficients of the heat sink and the cover such that a difference in the thermal expansion coefficient is reduced.

7. The lighting device of claim 1, wherein the cover comprises a foam portion disposed in at least one part of the cover to increase diffusion efficiency of light generated from the LED.

8. The lighting device of claim 1, further comprising:

a light characteristic control portion disposed between the cover and the LED to control characteristics of light generated from the LED.

9. The lighting device of claim 8, wherein the light characteristic control portion is integrally formed with at least one of the heat sink and the cover.

10. The lighting device of claim 8, wherein the light characteristic control portion comprises a diffusion plate disposed between the cover and the LED to increase diffusion efficiency of the light generated from the LED.

11. The lighting device of claim 8, wherein the light characteristic control portion comprises a fluorescent plate disposed between the cover and the LED to change a wavelength of the light generated from the LED.

12. The lighting device of claim 8, wherein the light characteristic control portion comprises a filter plate disposed between the cover and the LED to remove light of a particular wavelength from the light generated from the LED.

13. A lighting device, comprising:

a circuit substrate including a light emitting diode (LED) disposed on a first surface of the circuit substrate;

a heat sink including a seating portion in which a second surface of the circuit substrate is seated;

a cover integrally bonded to the heat sink after co-extrusion of the heat sink and the cover such that the circuit substrate is disposed between the cover and the heat sink; and a shape control portion disposed at the heat sink around the seating portion to control a shape of the seating portion by securing heat radiation performance around the seating portion during the co-extrusion of the heat sink and the cover, the shape control portion including:

a first cooling path defined in the heat sink around the seating portion; and a second cooling path defined between an outside of the heat sink and the first cooling path to supply coolant to an inside of the first cooling path, wherein a part of at least one of the heat sink and the cover is separable such that the part forms a separate portion for coupling, wherein at least one of the cover and the heat sink is made of a deformable material to efficiently connect the separate portion, the at least one of the cover and the heat sink being elastically or plastically deformed during connection of the separate portion, and the separate portion is disposed at the heat sink in such a manner that the heat sink is separated with respect to the first cooling path and the second cooling path, thereby forming two separate pieces of the heat sink connected to opposite ends of the cover, respectively, wherein while the two separate pieces of the separate portion are connected, at least one heat radiating hole is formed independent of a fluid communication of the first cooling path and the second cooling path of the shape control portion.

14. The lighting device of claim 13, wherein the separate portion is coupled by any one of a bonding agent and a fastening member.

15. The lighting device of claim 13, wherein the heat sink and the cover have a tube shape.

16. The lighting device of claim 13, wherein the first cooling path and the second cooling path are defined at the heat sink to uniformly guide coolant to environs of the seating portion during the co-extrusion of the cover and the heat sink, the separate portion is disposed at the heat sink, and the two separate pieces are integrally bonded to the opposite ends of the cover, and the two separate pieces are couplable to each other.

17. The lighting device of claim 13, wherein the second surface of the circuit substrate and the seating portion have a curved or linear cross section to correspond to each other, and a cross section of the first cooling path has the same shape as a cross section of the seating portion such that the first cooling path is disposed in the heat sink to be parallel with the seating portion.

18. The lighting device of claim 13, wherein the second surface of the circuit substrate and the seating portion have at least one of a curved cross section and a linear cross section to correspond to each other to make surface contact with each other.

19. The lighting device of claim 13, wherein the cover is made of a transparent or translucent material while the heat sink is made of a material having higher heat radiation efficiency than the transparent or translucent material of the cover.

20. The lighting device of claim 13, wherein at least one of the cover and the heat sink comprises a thermal expansion changing material that changes thermal expansion coefficients of the heat sink and the cover such that a difference in the thermal expansion coefficient is reduced.

21. The lighting device of claim 13, wherein the cover comprises a foam portion disposed in at least one part of the cover to increase diffusion efficiency of light generated from the LED.

22. The lighting device of claim 13, further comprising:

a light characteristic control portion disposed between the cover and the LED to control characteristics of light generated from the LED.

23. The lighting device of claim 22, wherein the light characteristic control portion is integrally formed with at least one of the heat sink and the cover.

24. The lighting device of claim 23, wherein the light characteristic control portion comprises wings protruded from opposite inner surfaces toward a center of the cover such that ends of the wings overlap each other.

25. The lighting device of claim 22 wherein the light characteristic control portion comprises a diffusion plate disposed between the cover and the LED to increase diffusion efficiency of the light generated from the LED.

26. The lighting device of claim 22, wherein the light characteristic control portion comprises a fluorescent plate disposed between the cover and the LED to change a wavelength of the light generated from the LED.

27. The lighting device of claim 22, wherein the light characteristic control portion comprises a filter plate disposed between the cover and the LED to remove light of a particular wavelength from the light generated from the LED.

* * * * *